US007907052B2

(12) United States Patent
Delaney, Jr.

(10) Patent No.: US 7,907,052 B2
(45) Date of Patent: Mar. 15, 2011

(54) ENHANCED FIREFIGHTER DOOR CHOCK

(76) Inventor: John B. Delaney, Jr., Alexandria, VA (US)

( * ) Notice: Subject to any disclaimer, the term of this patent is extended or adjusted under 35 U.S.C. 154(b) by 300 days.

(21) Appl. No.: 12/208,339

(22) Filed: Sep. 11, 2008

(65) Prior Publication Data

US 2009/0072966 A1 Mar. 19, 2009

Related U.S. Application Data

(60) Provisional application No. 60/994,017, filed on Sep. 17, 2007.

(51) Int. Cl.
*G08B 1/08* (2006.01)
*G08B 3/00* (2006.01)
*H05B 39/00* (2006.01)

(52) U.S. Cl. ..... 340/539.11; 340/539.13; 340/539.26; 340/546; 340/691.1; 340/331; 340/332; 340/321; 292/343

(58) Field of Classification Search ..... 340/539.11
See application file for complete search history.

(56) References Cited

U.S. PATENT DOCUMENTS

| | | | | |
|---|---|---|---|---|
| 4,959,637 | A * | 9/1990 | Woods et al. | 340/573.1 |
| 5,021,794 | A | 6/1991 | Lawrence | |
| 6,317,047 | B1 * | 11/2001 | Stein et al. | 340/573.1 |
| 6,653,937 | B2 | 11/2003 | Nelson | |
| 6,690,288 | B1 * | 2/2004 | Waddell | 340/692 |
| 6,727,805 | B2 * | 4/2004 | Hollister et al. | 340/326 |
| 7,091,851 | B2 | 8/2006 | Mason | |
| 7,091,852 | B2 | 8/2006 | Mason | |
| 7,245,216 | B2 | 7/2007 | Burkeley | |
| 2005/0212682 | A1 * | 9/2005 | Petriello | 340/691.1 |
| 2006/0208920 | A1 * | 9/2006 | Carrella | 340/686.1 |

OTHER PUBLICATIONS

Roberts, M.R., Wireless Sensor System Guides Urban Firefighters, Dec. 1, 2006, Mobile Radio Technology, Penton Media, Inc.
Staff Writers, L-3 Wins Contract for Three Dimension Locator Systems for First Responders, Jan. 1, 2007, GPS Daily.
Unsigned, Innovative Concepts provides First Responder, 3D Locator Systems to L-3 in support of recent DHS Contract, press release, Mar. 21, 2007.
Unsigned, L-3 Communications, Interstate Electronics Corporation Awarded Homeland Security Contract for First Responder, Three Dimension Locator Systems, press release, Aug. 29, 2007.
Dorsey, Michael, WPI to Host National Forum on Locating First Responders Inside Buildings, Jul. 26, 2007, Worcester Polytechnic Institute.
Kumar, Vijay, et.al., Robot and Sensor Networks for First Responders, Pervasive Computing, pp. 24-33, Oct.-Dec. 2004.
Souryal, Michael S., et.al., Real-Time Deployment of Multihop Relays for Range Extensions, International Conference on Mobile Systems, Applications and Services, Proceedings of the 5th international conference on Mobile systems, applications and services, pp. 85-98, 2007.
Staff Writers, Michigan Fire Department to Implement Firefighter Tracking System, Ann Arbor News, 2008.
Staff Writers, New Approach to Ad Hoc Networks for First Responders Debuts, Science Daily, Aug. 9, 2008.

* cited by examiner

*Primary Examiner* — Donnie L Crosland
(74) *Attorney, Agent, or Firm* — Todd L. Juneau; Jason Tiedeman

(57) ABSTRACT

A portable electronic integrated fire fighting device used by firefighters and other emergency response workers to acquire and relay information, store sensory information, provide location data, and provide a point-to-point network with repeater capability. The portable electronic fire fighting device may include a housing, a radio frequency transmitter, a radio frequency receiver, a microprocessor, a communications interface, electronic memory, a power supply, and one or more sensors and may be configured in the form of a door chock, an axe handle, a fire fighter's hook handle, and a fire fighter's helmet. The portable electronic fire fighting device may also interface with a firefighter's heads-up display or other handheld device, or with other electronic fire fighting devices that are known in the art.

15 Claims, 1 Drawing Sheet

FIG. 1
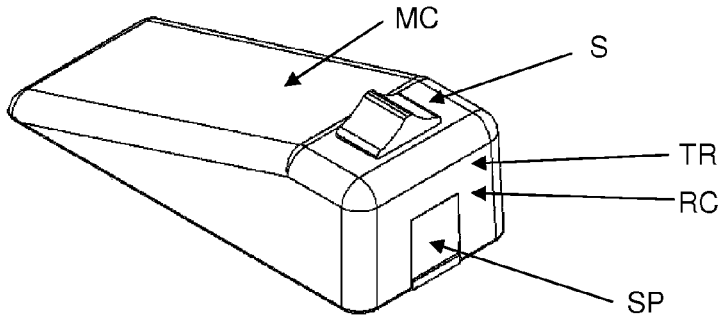
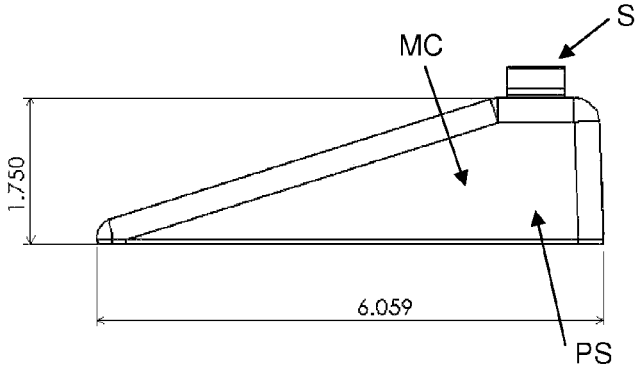
FIG. 2
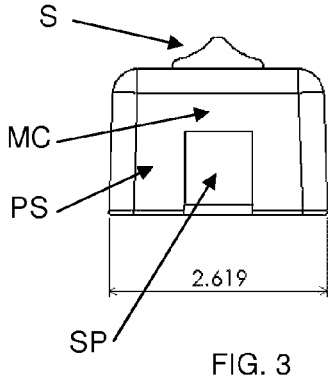
FIG. 3

ENHANCED FIREFIGHTER DOOR CHOCK

CROSS REFERENCE TO RELATED APPLICATIONS

This application claims priority under 35 U.S.C. 119(e) to U.S. provisional application Ser. No. U.S. Provisional 60/994,017 filed Sep. 17, 2007, the contents of which are incorporated herein in its entirety.

STATEMENT REGARDING FEDERALLY SPONSORED RESEARCH OR DEVELOPMENT

No federal government funds were used in researching or developing this invention.

BACKGROUND

1. Field of the Invention

This invention relates to safety equipment used by fire fighters and other emergency response workers.

2. Background of the Invention

The need to track the location and monitor the well-being of firefighters and emergency response workers inside structures is well understood. Several automated accountability, tracking, and communications systems have been described.

The door chock is a standard piece of gear that is carried by virtually every fire fighter within the United States. This simple wedge-like device is typically cut from wood and carried by fire fighters either on their helmet or within their personal protective equipment. The standard door-chock can be used in any manner imaginable, but is typically used during search and rescue or force entry operations where fire fighters want to ensure that access and egress points (i.e. door) remain open. This allows fire fighters the ability to quickly enter and exit an area should the location of a victim occur or conditions worsen. The only benefit of the standard door chock is that, in most instances, it keeps the doors from closing-in on fire fighters.

Fire fighters also make use of an audible alarm to indicate a man down. These devices known as PASS (Personal Alert Safety Systems) alarms are either integrated into fire fighters' self contained breathing apparatus or are stand alone devices attached to the fire fighters gear or equipment. The device activates an audible alarm when a fire fighter has not moved for a period of time.

There also exist several systems that use radio repeaters that can be placed throughout a building to maintain communications with and track fire fighters. These systems are designed to help locate a fire fighter inside a building or other structure. Due to the absorption and reflection of radio waves these systems often need to have repeaters placed throughout the building. This places an additional workload on the fire fighter and requires them to carry an additional piece of equipment.

U.S. Published Application 2006/208920 discloses a door stop beacon comprises a door stop for preventing a door from moving and a lamp connected to the door stop for indicating the door. Preferably, the door stop is a wedge-shaped door chock with a slope upper surface. A switch is placed underneath the slope upper surface so that it can be automatically activated by a pressure applied to the upper surface when the door chock is inserted underneath the door. Alternatively, the switch can be manually activated by a button. Preferably, the lamp is accommodated in a housing having multiple transparent surfaces through which the light of the lamp can pass, so that the light can be visible from various directions. Preferably the lamp is capable of strobing or flashing.

U.S. Pat. No. 7,245,216 discloses a First Responder Communications System (FRCS), also referred to as an Automated Incident Control System, is provided that supports inter-agency and intra-agency communications among first responders including fire, police, border patrol, emergency medical service, safety, and/or other agencies. The FRCS also increases situational awareness of personnel by automatically providing position information as well as other sensor information. The FRCS also provides position and time information via Global Positioning System (GPS) and/or other positioning systems, and data from deployed and/or personal sensors to provide enhanced communications, command and control capabilities to the first responders and incident command.

U.S. Pat. No. 7,091,852 discloses an emergency response personnel automated accountability system, also referred to as a Firefighter Automated Accountability System (FAAS), is provided that supports automatic tracking of and limited communications among first responders including fire, police, emergency medical service, and safety personnel. The FAAS increases situational awareness and safety of first responder personnel by automatically providing position information as well as other sensor information. Components of the FAAS integrate wireless mesh networks with positioning and communication systems to support real-time tracking of and communications with emergency response personnel. The FAAS incident awareness system provides position and time information via Global Positioning System (GPS) and/or other positioning systems, and processed data from sensors to provide enhanced communications, command and control capabilities to the first responders and incident command at the incident scene.

U.S. Pat. No. 7,091,851 discloses a communication accessory device is provided for use with a portable communication device like a radio. The accessory device, which couples to the standard communication device, includes a network system that automatically assembles a wireless network among other similarly equipped portable communication devices and control devices in an incident area and automatically assigns a unique identification to each portable communication device. The accessory device also includes a communication system that receives and transmits voice and data communications over the wireless network using at least one of High Frequency (HF), Very High Frequency (VHF), Super High Frequency (SHF), Ultra High Frequency (UHF)/microwave, public safety band, cellular, satellite, and Public Switched Telephone Network (PSTN) communications.

U.S. Pat. No. 6,653,937 discloses a method of electronically tracking and locating a very large number of objects such as, but not limited to, personal case files in health care, law, or human services systems is described. Each object to be tracked has an attached miniature radio transmitter called a tag which sends a coded signal to a network of receiver base stations with limited but overlapping reception ranges. Each receiver base station places in its own memory the time at which a record enters its range, remains in range, and the time at which it leaves. The various receiver base stations are interconnected to a host computer. By polling the memories of each receiver base station, the computer is able to determine the current location of any record.

U.S. Pat. No. 5,021,794 discloses a radio transmitter in a miniaturized transceiver concealed on a person to be located, such as a lost child, is activated and transmits a coded UHF radio homing signal upon receipt of an initiating signal containing the child's address code. The initiating signal is automatically transmitted by a repeater station in response to an audible "panic signal" containing the address code and contains the identical address code. The panic signal is a pulse tone produced by a hand held tone generator activated by the child's parent and is transmitted to the repeater station by telephone. Tracking vehicles are provided with automatic UHF radio direction finding and distance measuring equipment for locating the source of the homing signal. Stored information concerning the child can be transmitted to the tracking vehicles.

BRIEF SUMMARY OF THE INVENTION

In a preferred embodiment, provided herein is a portable electronic fire fighting device, comprising: a housing; a radio frequency transmitter; a radio frequency receiver; a microprocessor; a communications interface; electronic memory; a power supply; and one or more sensors; wherein the power supply is operatively connected to the electronic memory and the microcontroller; wherein the microcontroller is in operative communication with the receiver, the transmitter, the electronic memory, and the communications interface; wherein the one or more sensors is selected from the group consisting, in part, of a temperature sensor, a carbon monoxide gas sensor, a hydrogen sulfide gas sensor, an oxygen gas sensor, and a radiation sensor; and, wherein the housing takes a shape selected from the group consisting of a door chock, an axe handle, sledge hammer handle, a fire fighter's hook handle, and a fire fighter's helmet or boot.

In additional preferred embodiments, there is provided a portable electronic fire fighting device as described which further comprises a switch electrically connected to said device for turning on and off said one or more sensors.

In additional preferred embodiments there is provided wherein said switch is manually activatable by a switch button provided on an outer surface of said housing, or wherein said switch is automatically activatable when said device is in its operation position.

In one preferred embodiment, there is provided wherein said housing is a wedge-shaped door chock having a hypotenuse surface, a vertical surface and a bottom surface, or further comprising a switch located within said housing and activatable to turn on said one or more sensors by application of a compressive force applied to said housing.

In another preferred embodiment, there is provided a door chock as described herein, further comprising a lamp disposed within said housing and electrically connected to said power supply and said microcontroller.

In another preferred embodiment, there is provided a device which allows an additional radio relay between the person inside the building and supervisors outside or in another part of the building controlling the operation.

BRIEF DESCRIPTION OF THE DRAWINGS

FIG. 1 is a perspective view of an embodiment of the present inventive subject matter.

FIG. 2 is a side view of the embodiment shown in FIG. 1.

FIG. 3 is a rear view of the embodiment shown in FIG. 1.

DETAILED DESCRIPTION OF THE INVENTION

The Enhanced Door Chock (EDC) turns a singularly functioning tool into a multi-operational device that enhances fire department operations and safety, fire fighter accountability, general knowledge, and situational awareness. The EDC enhances search and rescue operations because it guides fire fighters to the location of placement of the EDC, through visual, audible, and heat indicators. Fire fighters are able to locate the device via the strobe-light, audible indicators, the heat signature from the device, or the wireless transmission of the actual location to fire fighters' heads-up display or other handheld device.

Additionally, the EDC is a vital component within the fire fighter accountability system. Fire fighter accountability in this post-9/11 era is of paramount importance. The fire service has been largely relegated to using antiquated systems for tracking and accountability purposes. These systems are inherently unreliable because they do not provide continual automatic updates, require definitive action on the part of the user, and are difficult to manage and maintain accurately during emergency operations. Typically, incident commanders attempt to maintain accountability of fire fighters through the use of portable communication devices (radios) whereby fire fighters provide his/her location when requested. This portion of the system requires that accurate information is relayed and recorded on regular bases.

The development of an accountability system that automatically senses, tracks, locates, and identifies fire fighters operating is vitally important, not only to the safety and well being of fire fighters, but to the populace they serve. A reliable and accurate fire fighter accountability system will only enhance fire department operations which, in turn, will save more lives.

The EDC is a multi-purpose tool and resource designed specifically to enhance the capabilities of fire fighters operating in a hazardous environment while simultaneously sensing, tracking, locating, and identifying each fire fighter. Not only does the EDC function as a standard wooden door chock but it has additional features that further enhance fire fighter safety, accountability, and tactical operations. The EDC acts as a communication link between fire fighters and incident commanders; the EDC is a reference marker for fire fighter tracking purposes; and a relay device for sending voice and data between individuals, units, and commanders.

The EDC houses various sensors which, when placed into service, provide and relay information wirelessly. These sensors enhance fire fighter awareness through wirelessly communicating interior conditions such as, carbon monoxide, oxygen, hydrogen sulfide, temperature levels, flammable gases, radiation levels and lower and upper explosive limits. The sensors are also able to communicate with incident commanders and safety officers by relaying interior conditions, fire fighter vital signs, and fire fighter locations.

The EDC is activated automatically or manually. The device automatically activates once sufficient force is applied to the EDC. This activates the exterior LED strobe light, interior sensors, and communications. A high pitched quick chirp is also initiated. This feature activates every 5 seconds. An exterior switch allows independent activation of the device.

The technology described above is also utilized in standard fire fighter equipment and personal protective equipment as a method of enhancing fire fighter tracking and safety. This technology can be embedded into fire fighting boots, belts, and helmets, as well as, various hand-tools typically utilized in fire fighting. The technology can be modified to fit into the handles of hand-tools carried by fire fighters, such as an axe, hook, sledge hammer. However the present invention is not limited to only the above tools and can be used in potentially any tool used by a fire fighter or any piece of personal protective equipment that will accept this device.

Referring now to the figures, FIG. 1 shows an exemplary door chock embodiment, and in this example, having a switch (S), and a sensor panel (SP) at the lower, front part of the vertical surface. FIG. 1 illustrates in this embodiment how the chock is shaped to be wedged underneath a door, at the hinge area of a door, or in other ways as a fire fighter may need in a given situation. FIG. 1 shows further internal features of the exemplary door chock including a microcontroller (MC), a transmitter (TR), a receiver (RC), and a power source (P). These features are internal to the door chock and their indicated position in FIG. 1 is intended to be exemplary.

The radio frequency electronics contemplated as within the scope of the present invention include network compliant electronics known to a person of skill in the electronics art. Example include active RFID networks, and ad hoc networks such as those having IEEE designations.

In operation, the unit would transmit its location to a control station, along with any other information from its sensor(s). When a sufficient number of devices are located within a particular emergency response area, e.g. a fire within a building, the devices are also capable of communicating with each other in addition to the control station. This way, a mesh network or a pseudo GPS point-to-point network can be established, and when combined with sensors placed directly on emergency response personnel, e.g. their helmet or gear, such as an axe, a supervisor can have nearly complete situational awareness relating to personnel and conditions within the emergency area.

The devices are also capable of acting as a repeater to strengthen the signal of a responder's handheld radio to ensure communication outside the emergency area.

A light, such as a strobe light, is also contemplated as within the scope of the invention as an additional feature. The light would be disposed within the housing, with the bulb protected by a surface panel, and powered by the power supply located within the device.

Referring now to FIG. 2 and FIG. 3, the dimensions of one embodiment is shown. In this figure, the height and length are listed as 1.750×6.059, and the width as 2.619. These measures refer to both inches as well as centimeters, and are not intended to be limiting but are intended to be illustrative. However, it is contemplated that a range of dimensions are within the scope of the invention. For example, the height and width may be between about 2 and about 7 centimeters, and the length may be between about 3 to about 10 centimeters. FIG. 2 shows further features of the exemplary door chock including a microcontroller (MC), a power source (PS), and a switch (S). FIG. 3 shows further features of the exemplary door chock including a switch (S), a sensor panel (SP), a microcontroller (MC), and a power source (PS). The microcontroller (MC) and power source (PS) indicated in FIG. 2 and FIG. 3 are internal to the door chock and their indicated positions are intended to be exemplary.

The device may be constructed of appropriate known materials. The housing may be wood, plastic, plastic composites, aluminum, steel, ceramic, fiber based materials, alloys, and so forth.

The references recited herein are incorporated herein in their entirety, particularly as they relate to teaching the level of ordinary skill in this art and for any disclosure necessary for the commoner understanding of the subject matter of the claimed invention. It will be clear to a person of ordinary skill in the art that the above embodiments may be altered or that insubstantial changes may be made without departing from the scope of the invention. Accordingly, the scope of the invention is determined by the scope of the following claims and their equitable Equivalents.

What is claimed is:

1. A portable electronic fire fighting device for use in a point-to-point network, comprising:

a housing;

a radio frequency transmitter;

a radio frequency receiver;

a microprocessor;

a communications interface;

electronic memory;

a power supply; and one or more sensors;

wherein the microprocessor, electronic memory, and communications interface comprise a microcontroller;

wherein the power supply powers the microcontroller, transmitter, receiver, and one or more sensors;

wherein the microcontroller is programmed with interfacing firmware;

wherein the microcontroller interfaces with the receiver, the transmitter, and the one or more sensors;

wherein the one or more sensors collects sensor information selected from the group consisting of temperature, carbon monoxide gas, hydrogen sulfide gas, oxygen gas, GPS, and radiation; and, wherein the housing takes a shape selected from the group consisting of a door chock, an axe handle, a fire fighter's hook handle, and a fire fighter's helmet, wherein the microcontroller provides each portable electronic fire fighting device with a unique electronic identification;

wherein the microcontroller is programmed with communications firmware to communicate with other portable electronic fire fighting devices;

wherein the microcontroller is programmed with additional communications firmware to communicate with a firefighter's heads-up display device and handheld electronic devices;

wherein the microcontroller is programmed with repeater firmware that collects sensor information and unique electronic identification information transmitted from local portable electronic fire fighting devices and transmits said sensor information and unique electronic identification information using the radio frequency transmitter.

2. The portable electronic fire fighting device of claim 1, further comprising a switch electrically connected to said device for turning on and off said one or more sensors.

3. The portable electronic fire fighting device of claim 2, wherein said switch is manually activatable by a switch button provided on an outer surface of said housing.

4. The portable electronic fire fighting device of claim 2, wherein said switch is automatically activatable when said device is in its operation position.

5. The portable electronic fire fighting device of claim 1, wherein said housing is a wedge-shaped door chock having a hypotenuse surface, a vertical surface and a bottom surface.

6. The portable electronic fire fighting device of claim 5, further comprising a switch located within said housing that is activatable to turn on said one or more sensors by application of a compressive force applied to said housing.

7. The door chock of claim 6, further comprising wherein the compressive force comprises an amount of force within the range of force caused when said door chock is used on a door.

8. The door chock of 1, further comprising a lamp disposed within said housing and electrically connected to said power supply and said microcontroller.

9. The portable electronic fire fighting device of claim 1, further comprising wherein the device repeats radio communication signals from fire fighter hand-held communication radios.

10. The portable electronic fire fighting device of claim 1, further comprising wherein the transmitter of the device communicates with other devices within a network.

11. The portable electronic fire fighting device of claim 1, further comprising wherein said electronic fire fighting device transmits position and sensor information that is receivable and interpretable by other electronic devices.

12. The portable electronic fire fighting device of claim 1, further comprising wherein said electronic fire fighting device stores data from said sensors in electronic memory.

13. The portable electronic fire fighting device of claim 1, further comprising wherein said electronic fire fighting device transfers stored data to another electronic device.

14. The portable electronic fire fighting device of claim 1, further comprising wherein said electronic fire fighting device has a panic button.

15. A method of establishing point-to-point network communication between portable electronic fire fighting devices described in claim 1, comprising the step of:

repeating sensor and electronic identification information from a first portable electronic fire fighting device to a second portable fire fighting device, wherein the first device has collected, stored, and transmitted information to the second portable fire fighting device and the second portable fire fighting device further transmits the information.

* * * * *